US012109602B2

(12) United States Patent
Galli et al.

(10) Patent No.: US 12,109,602 B2
(45) Date of Patent: Oct. 8, 2024

(54) STRETCHING MACHINE FOR EXTRUDED PROFILES

(71) Applicant: DANIELI & C. OFFICINE MECCANICHE S.P.A., Buttrio (IT)

(72) Inventors: Alessandro Mario Galli, Costa Masnaga (IT); Mattia Merlini, Brescia (IT)

(73) Assignee: DANIELI & C. OFFICINE MECCANICHE S.P.A., Buttrio (IT)

( * ) Notice: Subject to any disclaimer, the term of this patent is extended or adjusted under 35 U.S.C. 154(b) by 66 days.

(21) Appl. No.: 16/897,141

(22) Filed: Jun. 9, 2020

(65) Prior Publication Data

US 2020/0391268 A1 Dec. 17, 2020

(30) Foreign Application Priority Data

Jun. 13, 2019 (IT) ..... 102019000008889

(51) Int. Cl.
*B21D 3/12* (2006.01)
*B21C 23/14* (2006.01)

(52) U.S. Cl.
CPC ..... *B21D 3/12* (2013.01); *B21C 23/142* (2013.01)

(58) Field of Classification Search
CPC ..... B21D 3/12; B21D 3/02; B21D 3/00–04; B21D 25/00; B21D 25/04; B21C 23/142; B21C 35/02; B21C 35/03
USPC ..... 72/256, 257, 294–311
See application file for complete search history.

(56) References Cited

U.S. PATENT DOCUMENTS 2,720,310 A * 10/1955 Yack ..... B21C 23/08 72/364
2,920,755 A * 1/1960 Talbot ..... B21D 25/00 235/103
3,819,073 A * 6/1974 Asselborn ..... H01B 13/0003 414/431

(Continued)

FOREIGN PATENT DOCUMENTS

CN 201012367 Y 1/2008
CN 105032961 A 11/2015
EP 3335813 A1 6/2018

OTHER PUBLICATIONS

All About Circuits (website: https://web.archive.org/web/20150630034540/https://www.allaboutcircuits.com/textbook/alternating-current/chpt-13/selsyn-synchro-motors/) (Jun. 30, 2015) accessed Aug. 5, 2022 (Year: 2015).*

(Continued)

*Primary Examiner* — Christopher L Templeton
*Assistant Examiner* — Fred C Hammers
(74) *Attorney, Agent, or Firm* — Stetina Brunda Garred & Brucker

(57) ABSTRACT

A stretching machine for extruded profiles comprises a stretching head capable of translating along a predetermined direction (X) on a basement and actuation means for translationally actuating the stretching head with respect to the basement. The actuation means comprise a mechanical drive comprising at least one motor element, which is integral with one of said stretching head and said basement, and at least one driven element, operatively connected to the at least one motor element and integral with the other of said stretching head and said basement, and an electric motor operatively connected to the motor element of the mechanical drive.

5 Claims, 3 Drawing Sheets

(56) References Cited

U.S. PATENT DOCUMENTS

| | | | | |
|---|---|---|---|---|
| 4,050,278 | A * | 9/1977 | Asano | B21C 35/03 72/256 |
| 5,333,420 | A * | 8/1994 | Eden | B60P 3/34 52/64 |
| 2007/0051847 | A1* | 3/2007 | Quitmeyer | H02K 7/06 475/5 |
| 2009/0320549 | A1* | 12/2009 | Yamamoto | B21C 35/04 72/419 |
| 2014/0102714 | A1* | 4/2014 | Villareal | E21B 49/10 175/320 |

OTHER PUBLICATIONS

Search Report and Written Opinion for Italian Application No. 102019000008889, Feb. 14, 2020, 6 pages.
Chun Hua Wang et al., Finishing Operator, publication date Jan. 1, 2000, pp. 9-10, China Building Materials Press.

* cited by examiner

STRETCHING MACHINE FOR EXTRUDED PROFILES

CROSS-REFERENCE TO RELATED APPLICATIONS

This application claims priority to Italian Patent Application No. 102019000008889 filed on Jun. 13, 2019, the disclosure of which is expressly incorporated herein by reference.

STATEMENT RE: FEDERALLY SPONSORED RESEARCH/DEVELOPMENT

Not Applicable

FIELD OF THE INVENTION

The present invention relates to the sector of production of extruded profiles. In particular, the invention relates to a stretching machine for extruded metal profiles, in particular aluminum profile bars.

PRIOR ART

It is known that the production process of metal profiles by extrusion typically provides a rapid cooling of the profile by jets of air or water after it exits from the extrusion press. As a result of such operation and often asymmetrical cross-section shapes, internal strains are created in the newly extruded profile which cause a deformation, particularly in the longitudinal direction, so that the newly extruded profile takes on a longitudinally curved shape, e.g. banana or snake-shaped.

To eliminate such deformation and restore a straight course, the profile is stretched in special stretching machines, which can apply a tensile force at the ends of the profile exceeding the yield strength of the material, so as to cause the permanent straightening of the profile itself.

The known extruded profile stretching machines for extruded profiles substantially comprise a basement onto which a stretching head and a counter-head are mounted, both equipped with a gripping vice to clamp the profile at its longitudinal ends and apply the stretching force to it. The stretching head can translate on the basement along a fixed direction, defining the stretching direction. During operation, the stretching head is actuated in translation away from the counter-head, which is kept fixed, so that a tensile force is applied longitudinally onto the profile clamped between them adapted to determine the permanent straightening of the profile. The reaction to the applied stretching force is transferred from the stretching head to the counter-head through the basement.

Typically, in known extruded profile stretching machines, the stretching head is moved by means of a hydraulic cylinder having a drive rod connected to the stretching head and a casing integral with the basement. Such mode of operation, although capable of providing the necessary tensile forces to achieve stretching, has its drawbacks.

Indeed, the hydraulic drive systems require a special hydraulic circuit for the circulation of the pressurized operating fluid, in addition to the hydraulic actuator itself. This increases the complexity of the system and the maintenance costs of known extruded profile stretching machines, as well as being an additional source of potential breakdowns, and therefore has a negative impact on the construction and operating costs of such machines.

Furthermore, the hydraulic drive systems are particularly energy-consuming, because the pumps needed to keep the operating fluid pressurized and to circulate it are always in operation, regardless of the stress state of the actuated component. This drawback is particularly felt when high actuating forces and therefore correspondingly high operating fluid pressures are required, as is the case for the actuation of the stretching head of a stretching machine for extruded profiles, in which the pressure of the operating fluid which controls the hydraulic actuating cylinder must typically be in the order of a few hundred bars. This also has a negative impact on the operating costs of known extruded profile stretching machines.

Finally, a further drawback of hydraulic actuating systems is the possibility of leakages of operating fluid either in accidental conditions or during maintenance of the systems themselves, which makes the environment in which known extruded profile stretching machines are installed more prone to fouling and pollution.

SUMMARY OF THE INVENTION

It is the object of the present invention to provide a stretching machine for extruded profiles which overcomes the aforesaid disadvantages of known extruded profile stretching machines, the performance being the same.

More specifically, it is the object the present invention to provide a stretching machine for extruded profiles which has a simpler structure, lower construction and operating costs and which is more reliable and cleaner than the known stretching machines of extruded profiles of equal power.

According to the invention, such objects are achieved by a stretching machine for extruded profiles having the features set out in appended claim 1.

In particular, the invention relates to a stretching machine for extruded profiles comprising a stretching head capable of translating along a predetermined direction on a basement and actuation means for translationally actuating the stretching head with respect to the basement. The actuating means comprise a mechanical drive or transmission comprising at least one motor element which is integral with one of said stretching head and said basement and at least one driven element, operatively connected to the at least one motor element and integral with the other of said stretching head and said basement, and an electric motor operatively connected to the motor element of the mechanical drive.

In the stretching machine of the invention, the stretching head is actuated by an electromechanical actuation system formed by a mechanical drive and an electric motor. Such an actuation system does not require a pressurized operating fluid as a means of transmitting the force and therefore all the accessory components required to keep the operating fluid pressurized and to circulate it, in particular the whole of pipes forming the hydraulic circuit of the operating fluid and the respective hydraulic power unit. This makes the structure of the stretching machine of the invention simpler than the stretching machines of the prior art and, consequently, makes its construction, installation, and maintenance easier and more cost-effective.

A simpler and more robust design of the stretching head drive system also reduces the probability of failure of the system and thus increases the reliability of the stretching machine of the invention as a whole.

Furthermore, in the stretching machine of the invention, the electric motor of the electromechanical actuation system, unlike the pumping means of a hydraulic actuation system, is only active while the stretching head is moved or applies the traction force on the profile. The result is a reduction in the energy consumption of the stretching machine and therefore in its overall operating costs.

Finally, the absence of a circulating pressurized operating fluid prevents possible leakage of the same in case of failure, maintenance, or even during normal operation of the stretching machine. This allows maintaining a cleaner and healthier environment in which the stretching machine is installed.

Preferred configurations of the stretching machine of the invention are the subject of dependent claims, the contents of which are fully incorporated here by reference.

BRIEF DESCRIPTION OF THE FIGURES

Further features and advantages of the present invention will be more apparent in light of the detailed description of a preferred, but not exclusive, embodiment thereof, illustrated by the way of non-limiting example, with reference to the accompanying drawings, in which.

DETAILED DESCRIPTION OF PREFERRED EMBODIMENTS OF THE INVENTION

Figure 1:
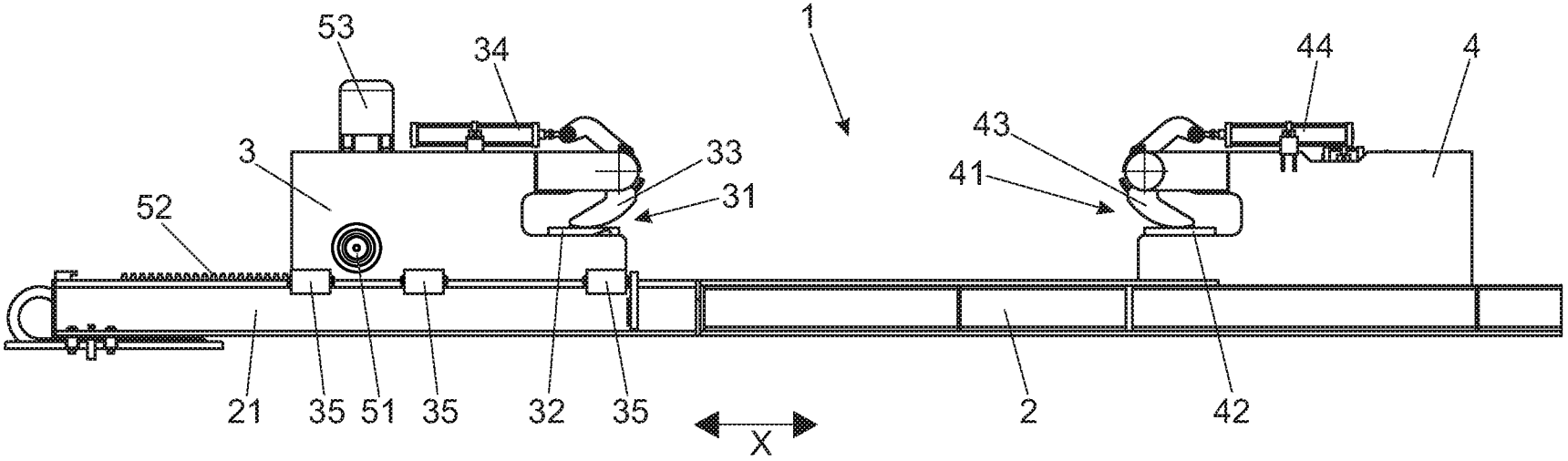
FIG. 1 diagrammatically shows a side view of a preferred embodiment of a stretching machine for extruded profiles according to the invention.

FIG. 1 diagrammatically shows a preferred embodiment of a stretching machine for extruded profiles according to the present invention, indicated as a whole by reference numeral 1.

The stretching machine 1 is preferably although not exclusively used for stretching metal profiles, in particular aluminum profile bars, after their extrusion. The stretching machine 1 described in detail here is configured in particular to operate on a processing line separate from the profile extrusion line. The extruded profiles are transferred from the extrusion line to the stretching machine by known means of transport, e.g. roller conveyors. Alternatively, the stretching machine 1 may also be placed on the extrusion line, downstream of the extrusion press.

The stretching machine 1 comprises a beam-shaped basement 2 with a longitudinal axis which defines a stretching direction X of the stretching machine 1. The length of basement 2 is chosen according to the length of the extruded profiles to be stretched. For example, in the case of aluminum profile bars, the length of basement 2 can typically be between approx. 10 m and approx. 70 m.

A stretching head 3 and a counter-head 4, intended to clamp opposite longitudinal ends of an extruded profile to be stretched are mounted on basement 2, at its longitudinal ends.

The stretching head 3 is the movable part of the stretching machine 1 and during the stretching process, it is translated on basement 2 in the stretching direction X by means of special drive means, described in more detail below, to apply the desired stretching force to the extruded profile to be stretched.

The counter-head 4 is the stationary part of the stretching machine 1 and is kept fixed during the stretching process. Preferably, the position of the counter-head 4 on basement 2 in relation to the stretching head 3 is adjustable, either continuously or discontinuously. In such a manner, the same stretching machine 1 can advantageously be used to stretch extruded profiles of different lengths.

With the exception of the actuation units provided for the handling of the stretching head 3, the latter and the counter-head 4 have a substantially similar configuration.

In particular, the stretching head 3 and the counter-head 4 comprise a respective gripping vice or clamp 31, 41, adapted to clamp a longitudinal end of an extruded profile, to apply the stretching force to the latter. The gripping vices 31 and 41 are structurally and functionally the same. Their characteristics will, therefore, be described below with particular reference to the gripping vice 31 of the stretching head 3, it being understood that this also applies to gripping vice 41 of the counter-head 4, the components of which are numbered accordingly.

The gripping vice 31 is defined in a longitudinal, essentially U-shaped cavity of a frame of the stretching head 3. The longitudinal cavity is preferably open at three sides of the stretching head 3, in particular, a front transverse side facing the counter-head 4, and preferably two opposite longitudinal sides. By virtue of this configuration, the loading/unloading of extruded profiles into/from the stretching machine 1 can take place sideways, in particular in a direction perpendicular to the stretching direction X, which is particularly advantageous in cases where the stretching machine 1 is on a separate and parallel processing line with respect to the extrusion line.

Figure 2:
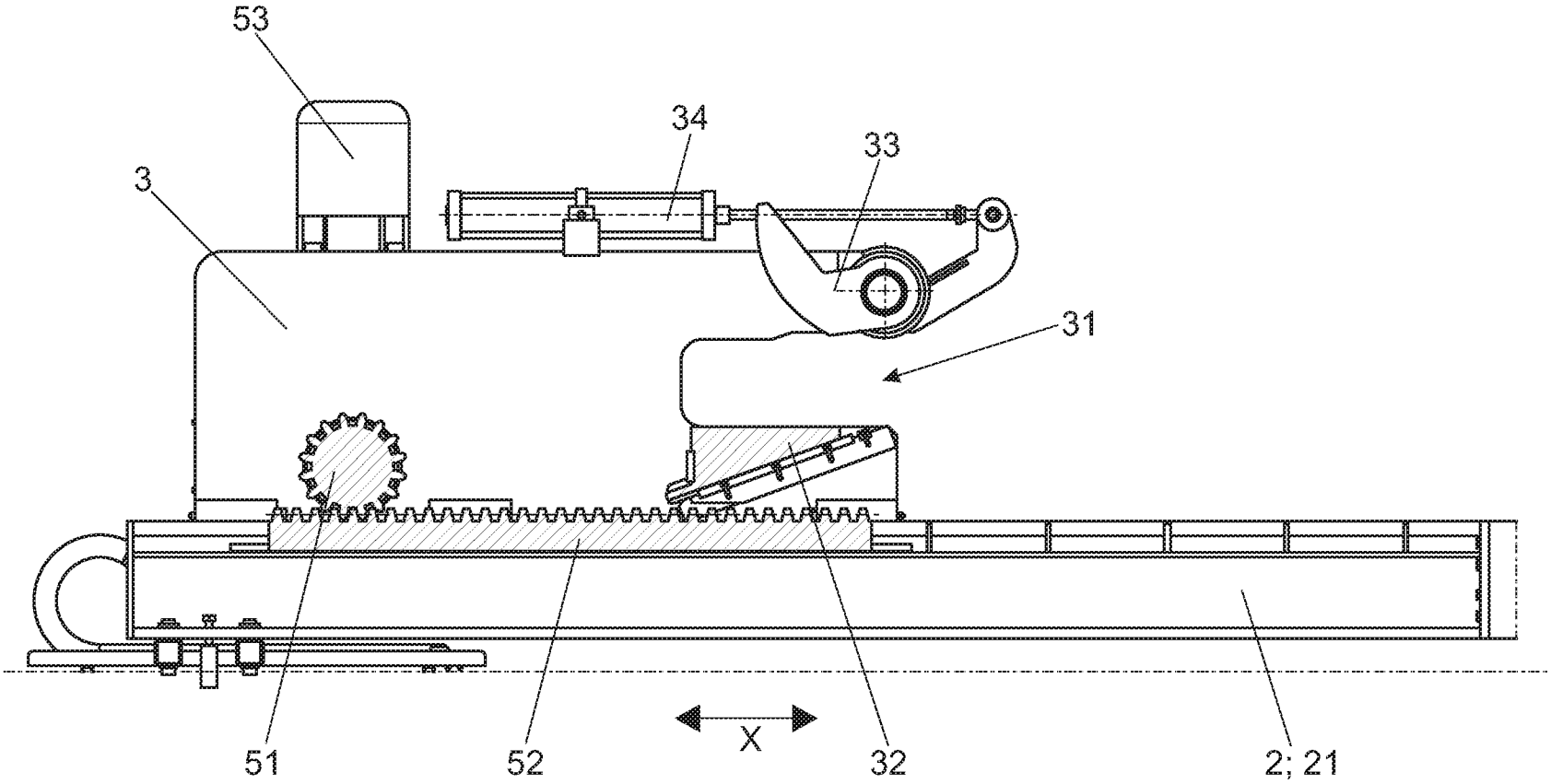
FIG. 2 diagrammatically shows a partial section side view of the stretching head and a portion of the basement of the stretching machine in FIG. 1.
Figure 3A:
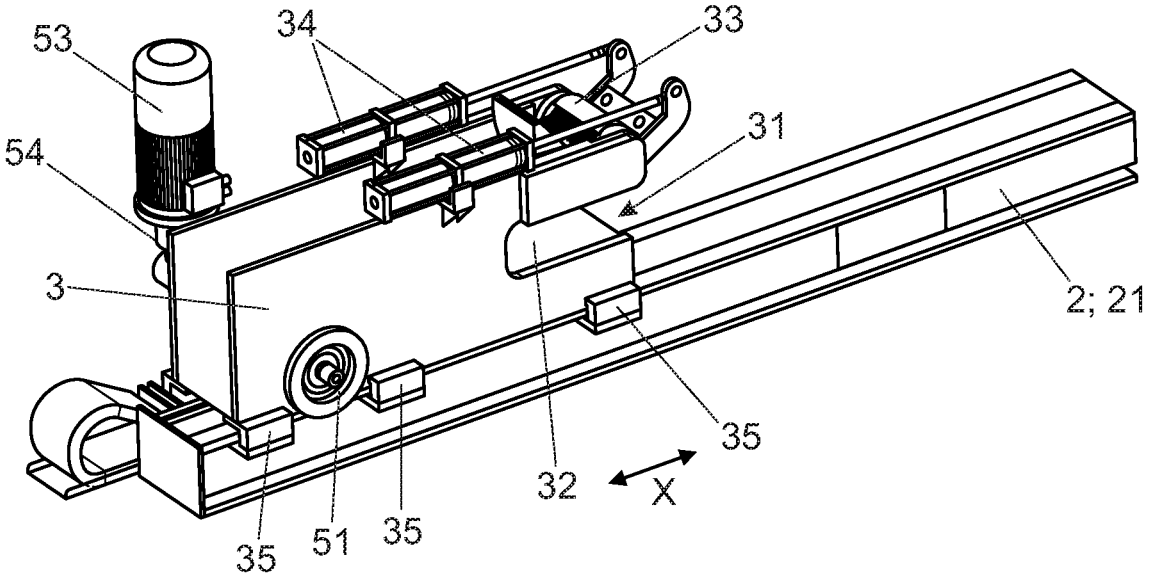
FIG. 3*a* diagrammatically shows a perspective view of the stretching head and a portion of the basement of the stretching machine in FIG. 1 and FIG. 3*b* diagrammatically shows a perspective view similar to the one in FIG. 3*a*, in which parts of the stretching head have been removed for the sake of visibility.
Figure 3B:
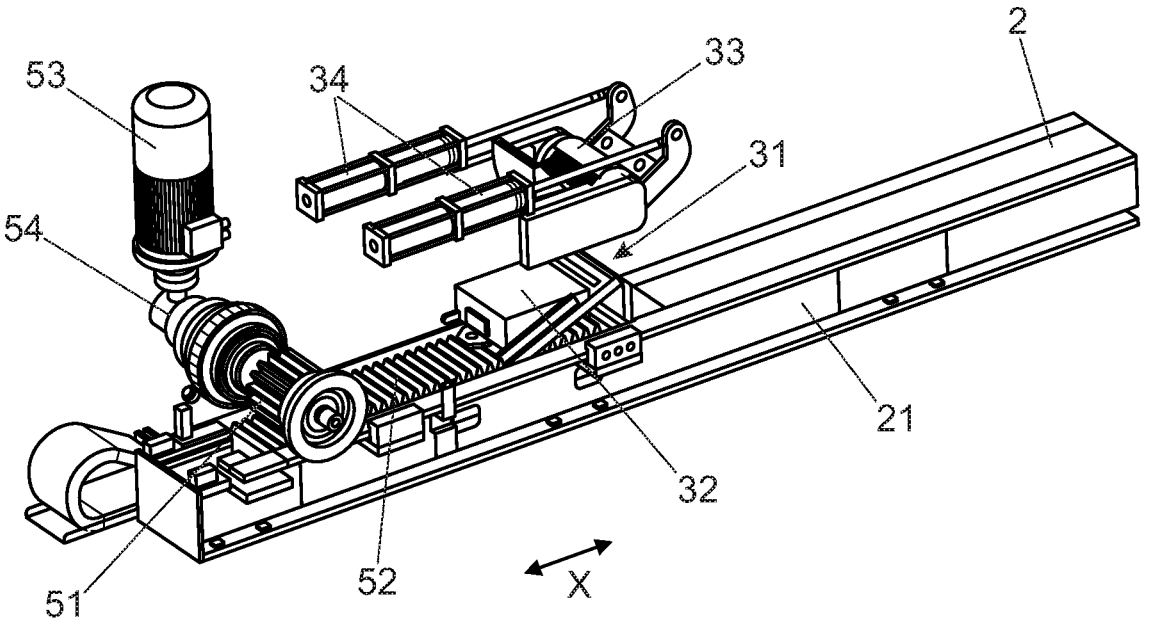

The gripping vice 31 preferably comprises a fixed supporting surface 32, attached to the frame of the stretching head 3 and a clamping element 33 which is movable between an operating or clamping position, shown in FIG. 1, and a non-operating position, shown in FIGS. 2, 3*a*, and 3*b*. In the preferred embodiment of the stretching machine 1 shown here, the clamping element 33 is configured as a rotating element pivoting about a rotation axis perpendicular to the longitudinal axis of the stretching machine, i.e. to the stretching direction X. The rotation of the clamping element 33 is preferably controlled by one or more dedicated linear actuators 34, which are operationally connected to clamping element 33, e.g. hydraulic cylinders. Alternatively, the clamping elements 33 can be rotated between the operating and non-operating positions through a ratio motor mounted directly on the rotation axis of the elements themselves.

As mentioned above, the stretching head 3 can move longitudinally, i.e. in the stretching direction X, on basement 2 with respect to the counter-head 4, to apply a desired stretching force on an extruded profile.

A rectilinear guide rail 21 is preferably formed on or applied to at least an end stretch of basement 2 to guide the movement of the stretching head 3. The stretching head 3 cooperates with the guide rail 21 through runner blocks 35 or other equivalent sliding or rolling elements.

The translation stroke of the stretching head 3 is substantially related to the length of the extruded profiles to be stretched. Typically, such stroke is about 3% of the length of the extruded profile to be stretched.

The movement of the stretching head 3 is controlled through electromechanical type actuation means.

In particular, the actuation means of the stretching head 3 preferably comprise a mechanical drive comprising a motor element 51 integral with the stretching head 3 or with basement 2 and a driven element 52 integral with basement 2 or with the stretching head 3 and operationally connected to the motor element 51. The motor element 51 of the mechanical drive is actuated by an electric motor 53.

As shown, in particular, in FIGS. 2, 3*a*, and 3*b*, in the preferred embodiment of the stretching machine 1 shown here the mechanical drive through which the stretching head 3 is translated is a rack and pinion drive. The motor element 51 is, in this case, formed by a pinion integral with the stretching head 3 and having a rotation axis perpendicular to the stretching direction X of the stretching machine 1, i.e. the longitudinal axis of basement 2, and the driven element 52 is formed by a rack integral with basement 2 fixed and extending longitudinally in the stretching direction X of the stretching machine 1.

A rack and pinion mechanical drive is a particularly simple and robust solution to move the stretching head 3 and generate the required stretching force. Furthermore, this solution is easily scalable, as the stretching force can be increased by increasing the number of active pinions on the rack.

Preferably, the motor or pinion element 51 is operationally connected to the electric motor 53 with the interposition of a reduction gear 54 (see FIGS. 3*a*, 3*b*), preferably a planetary gear.

Preferably, to reduce the overall dimensions of the stretching machine 1, the electric motor 53 has a rotation axis perpendicular to the rotation axis of the motor element 51. In this case, the reduction gear 54 interposed between the motor element 51 and the electric motor 53 is preferably an angular planetary gear. More preferably, the axis of the electric motor 53 is also perpendicular to the stretching direction X of the stretching machine 1. In other words, with reference to the installation arrangement of the stretching machine 1 shown in the figures, the electric motor 53 has preferably a vertical rotation axis.

In an alternative preferred embodiment of the stretching machine 1, not shown, in the rack and pinion mechanical drive described above it can be expected that the pinion, together with the electric motor 53 and the reduction gear 54, is integral with basement 2, and therefore stationary, and the rack is integral in translation with the stretching head 3, and therefore movable.

In another preferred alternative embodiment, also not shown, the mechanical drive can be a ball screw, recirculating roller screw, or satellite roller screw drive, in which a screw element forms the motor element 51 of the drive and a nut screw element forms the driven element 52 of the drive.

Also in this embodiment, it can be provided that the screw element is integral with the stretching head 3 and the nut screw element is integral with basement 2, or vice versa.

In all cases, the invention provides a stretching machine for extruded profiles in which the movement of the stretching head takes place without the use of hydraulic actuation systems, and which, therefore, has a simpler structure, lower construction and operating costs and which is more reliable and cleaner than the known stretching machines of the extruded profiles of equal power.

What is claimed is:

1. A stretching machine for extruded profiles comprising:

a stretching head capable of translating along a predetermined direction (X) on a basement, actuation means for translationally actuating the stretching head with respect to the basement and for generating a required stretching force, the actuation means comprising:

a mechanical drive comprising at least one motor element and at least one driven element, operatively connected to the at least one motor element, and an electric motor operatively connected to the motor element of the mechanical drive, with the interposition of a reduction gear, wherein the electric motor has a rotation axis perpendicular to a rotation axis of the motor element of the mechanical drive; and a counter-head having an adjustable position on the basement in relation to the stretching head and being kept fixed during a stretching process, wherein the stretching head and the counter-head are capable of clamping opposite longitudinal ends of said extruded profiles to be stretched and are mounted on the basement at the longitudinal ends of said extruded profiles;

wherein the mechanical drive is a rack and pinion drive, wherein the pinion forms said at least one motor element and the rack forms said at least one driven element, and wherein the pinion is integral with the stretching head and the rack is integral with the basement;

wherein at least a portion of the actuation means is coupled to the stretching head so as to move with the stretching head;

wherein the at least one motor element is the portion of the actuation means coupled to the stretching head so as to move with the stretching head.

2. The stretching machine according to claim 1, wherein the reduction gear is a planetary gear.

3. The stretching machine according to claim 1, wherein the reduction gear is an angular planetary gear.

4. The stretching machine according to claim 1, wherein the stretching machine is configured for operation independent of a profile extrusion line.

5. A stretching machine for extruded profiles comprising:

a stretching head capable of translating along a predetermined direction (X) on a basement, actuation means for translationally actuating the stretching head with respect to the basement and for generating a required stretching force, the actuation means comprising:

a mechanical drive comprising at least one motor element and at least one driven element, operatively connected to the at least one motor element, and an electric motor operatively connected to the motor element of the mechanical drive, with the interposition of a reduction gear, wherein the electric motor has a rotation axis perpendicular to a rotation axis of the motor element of the mechanical drive; and a counter-head having an adjustable position on the basement in relation to the stretching head and being kept fixed during a stretching process, wherein the stretching head and the counter-head are capable of clamping opposite longitudinal ends of said extruded profiles to be stretched and are mounted on the basement at the longitudinal ends of said extruded profiles;

wherein the mechanical drive is a rack and pinion drive, wherein the pinion forms said at least one motor element and the rack forms said at least one driven element, and wherein the pinion is integral with the stretching head and the rack is integral with the basement;

wherein at least a portion of the actuation means is coupled to the stretching head so as to move with the stretching head;

wherein the electric motor is the portion of the actuation means coupled to the stretching head so as to move with the stretching head.

* * * * *